US005373142A

United States Patent [19]

Ohshima et al.

[11] Patent Number: 5,373,142

[45] Date of Patent: Dec. 13, 1994

[54] CONTROL SYSTEM FOR A HEATING APPARATUS

[75] Inventors: Kohshou Ohshima, Yamatokoriyama; Masanori Harima, Nara; Tomoyuki Kawase, Kyoto; Tomokazu Itoh; Nobuo Sekino, both of Nara; Hirofumi Takemasa, Ibaraki; Kiyoaki Konno, Yamatokoriyama; Kensuke Mizuma, Nara, all of Japan

[73] Assignee: Matsushita Electric Industrial Co., Ltd., Kadoma, Japan

[21] Appl. No.: 68,953

[22] Filed: May 28, 1993

[30] Foreign Application Priority Data

Jun. 1, 1992 [JP] Japan ..... 4-140231

[51] Int. Cl.[5] ..... H05B 6/68

[52] U.S. Cl. ..... 219/506; 219/720; 219/719; 219/702; 99/325

[58] Field of Search ..... 219/10.55 B, 10.55 E, 219/10.55 M, 506, 720, 719, 702, 721, 718; 99/325

[56] References Cited

U.S. PATENT DOCUMENTS

| | | | |
|---|---|---|---|
| 4,430,540 | 2/1984 | Scalf | 219/10.55 B |
| 4,459,449 | 7/1984 | Hirata | 219/10.55 B |
| 4,517,428 | 5/1985 | Matsushima | 219/10.55 B |
| 4,841,125 | 6/1989 | Edamura | 219/10.55 B |
| 4,918,293 | 4/1990 | McGeorge | 219/506 |

*Primary Examiner*—Philip H. Leung

*Attorney, Agent, or Firm*—Spencer, Frank & Schneider

[57] ABSTRACT

A control control system for a heating apparatus such as a microwave oven. Manipulation, that is, selection of one of various menus and start of the operation thereof substantially completed by manipulating only one manipulating knob without using keys which are widely distributed on a manipulation panel, consequently, it is possible to simplify selection of a menu.

6 Claims, 12 Drawing Sheets

CONTROL SYSTEM FOR A HEATING APPARATUS

BACKGROUND OF THE INVENTION

The present invention relates to a control system for the manipulation of a heating apparatus such as a microwave oven or the like and, particularly, to an arrangement in which input sections required for operation are concentrated in a single location to improve manipulability.

The manipulability of a conventional microwave oven will be described with reference to FIG. 12 of the attached drawings. FIG. 12 shows the external appearance of a manipulating section of a microwave oven. Existing microwave ovens are capable of automatically measuring weight and detecting steam from a foodstuff by providing of sensors such as a weight sensor, a vapor sensor and the like. In keeping therewith, the number of cooking menus which can be cooked by a microwave oven has increased. Accordingly, the number of input keys corresponding to the cooking menus has also increased. In view of this, in a case where a plurality of keys must be arranged within a limited narrow space, the characters on the keys should be decreased in their size. Thus, there is a disadvantage in that it is difficult to read the characters.

In a case where a "high range" (HIGH POWER) usually used for manual cooking using microwaves is set, a "range high" key 14 is first pushed. It is noted that the term "range" used throughout the specification of microwave power for heating foodstuffs, that is, if the term "high-range" is used, it corresponds to high microwave power Subsequently, a selection setting means such as an encoder 8 (hereinafter simply referred to as "encoder") is rotated to perform a time setting. Subsequently, a "start" key 10-1 is pushed. Further, also in oven cooking employing an electric heater or the like, an "oven" key 15 is first pushed. A "temperature setting" key 13 (temperature changing key) is continuously pushed so as to set a required temperature Subsequently, the encoder 8 is rotated to thereby set a time. Then, the "start" key 10-1 is pushed. In this case, if the keys are spaced away from each other, or if the encoder is spaced from these keys, it is difficult to manipulate these keys.

On the other hand, in a case of "warming" (AUTO SENSOR REHEAT) in an automatic cooking mode using microwaves, which "warming" key 10-2 is pushed. Subsequently, the "start" key 10-1 should be pushed. Depending upon a one of various menus is selected, the operating methods are different from each other.

However, the fact that the manipulating methods are different from each other depending upon selected one of the various menus is selected is extremely troublesome and, particularly, raises a great problem since the fact that the manipulating methods are different from each other depending upon which one of the various menus is selected, makes it difficult for the microwave oven to be used for the aged. Further, since no manipulating procedure with which a cooking manipulation should be made on the oven is not exhibited, the problem becomes more serious. Moreover, recently the manipulating section has raised the following problems. That is, the number of keys has increased, and a large number of keys are displayed on a display section having a limited narrow area. As a result, many small characters are displayed therein. Consequently, when a person glances at the product, it makes or gives the impression that it would be difficult to use. This raises a serious problem.

SUMMARY OF THE INVENTION

In view of the above-discussed problems, it is an object of the invention to provide a heating apparatus which reduces the number of input keys as far as possible.

According to the invention, there is provided a heating apparatus which is arranged as follows. A rotatable first selective setting means (an encoder or the like) is located at the center of a manipulating section, and cooking start means (a start key section or the like) for inputting a manipulation start is arranged integrally with the selective setting means. A group of cooking menus is divided into a first group of cooking menus (a group of manual cooking menus or the like) and a second group of cooking menus (a group of automatic cooking menus or the like), and further a display section for the first group of cooking menus and a display section for the second group of cooking menus, are provided. In a case where the selective setting means is rotated in a predetermined one direction, the first group of cooking menus is selected to display the first group of cooking menus on the first display means. Depending upon the degree of rotation, a specific cooking menu within the first group of cooking menus is selected. Further, in a case where the selective setting means is rotated in the other direction, the second group of cooking menus is selected, and the second group of cooking menus is displayed. Depending upon the degree of rotation, a specific cooking menu within the second group of cooking menus is selected. Then the cooking start means is pushed, whereby the cooking operation will start. Moreover, the selective setting means is not performed, but the cooking start means is directly pushed, "warming" (AUTO MICROWAVE COOK); that is, a third cooking menu is selected, and the cooking operation starts. The "warming" menu is used with the highest frequency and, therefore, it should be easily selected.

In this manner, an object of the invention is as follows. The selection and operation start of the various kinds of cooking menus are substantially completed not by the input keys, which are distributed widely on an instruction panel, but only by operation of the selective setting means and cooking start means which are concentrated at a single location, whereby the manipulation can be simplified.

A further object of the invention is as follows. The arrangement is such that only rotation of the selective setting means can select a cooking menu which is then displayed. Then a cooking start means is pushed whereby the cooking operation of the selected cooking menu starts. The manipulation methods can be integrated with respect to all the cooking menus.

Further, another object of the invention is as follows. A setting key section for setting a temperature and a time, a display section therefor, a temperature and time setting display section, a finish adjustment key section, and a display section therefor are provided. A manipulating procedure is displayed whereby the manipulation is simplified.

Moreover, the other objects of the invention are as follows. That is, the order of the menus within the display section for the first group of cooking menus (the display section for the group of manual cooking menus, or the like) and the display section for the second group of cooking menus (the display section for the group of automatic cooking menus, or the like) is such that the display sections are arranged in the order of the frequency of use so that the cooking menu having the highest frequency of use can be selected by a minimum degree of rotation of the selective setting means, thereby making it possible to improve the manipulability of the heating apparatus.

DESCRIPTION OF THE EMBODIMENTS

Figure 1:
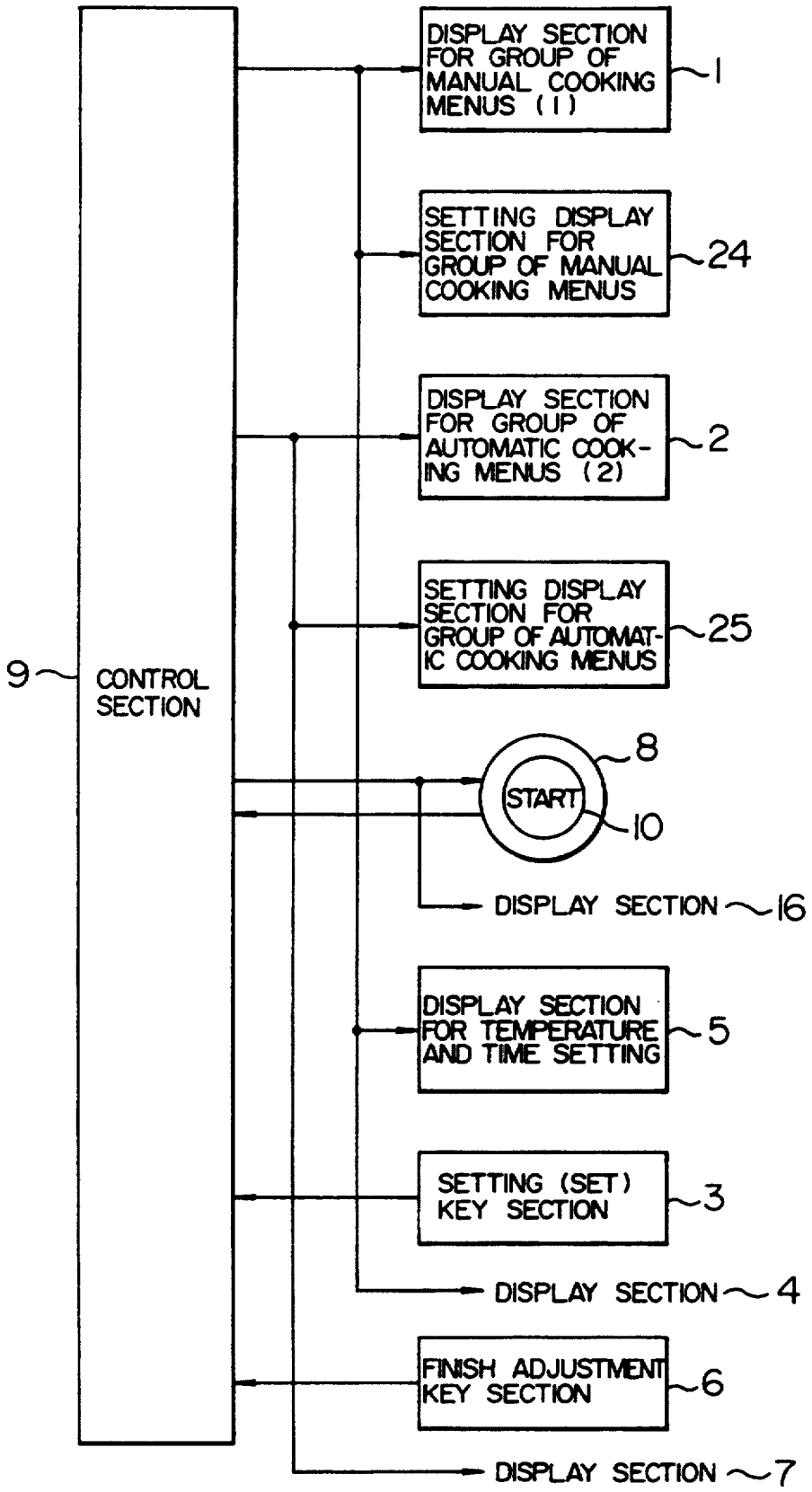
FIG. 1 is a block diagram illustrating a manipulating section of a microwave oven in an embodiment of the invention.
Figure 2:
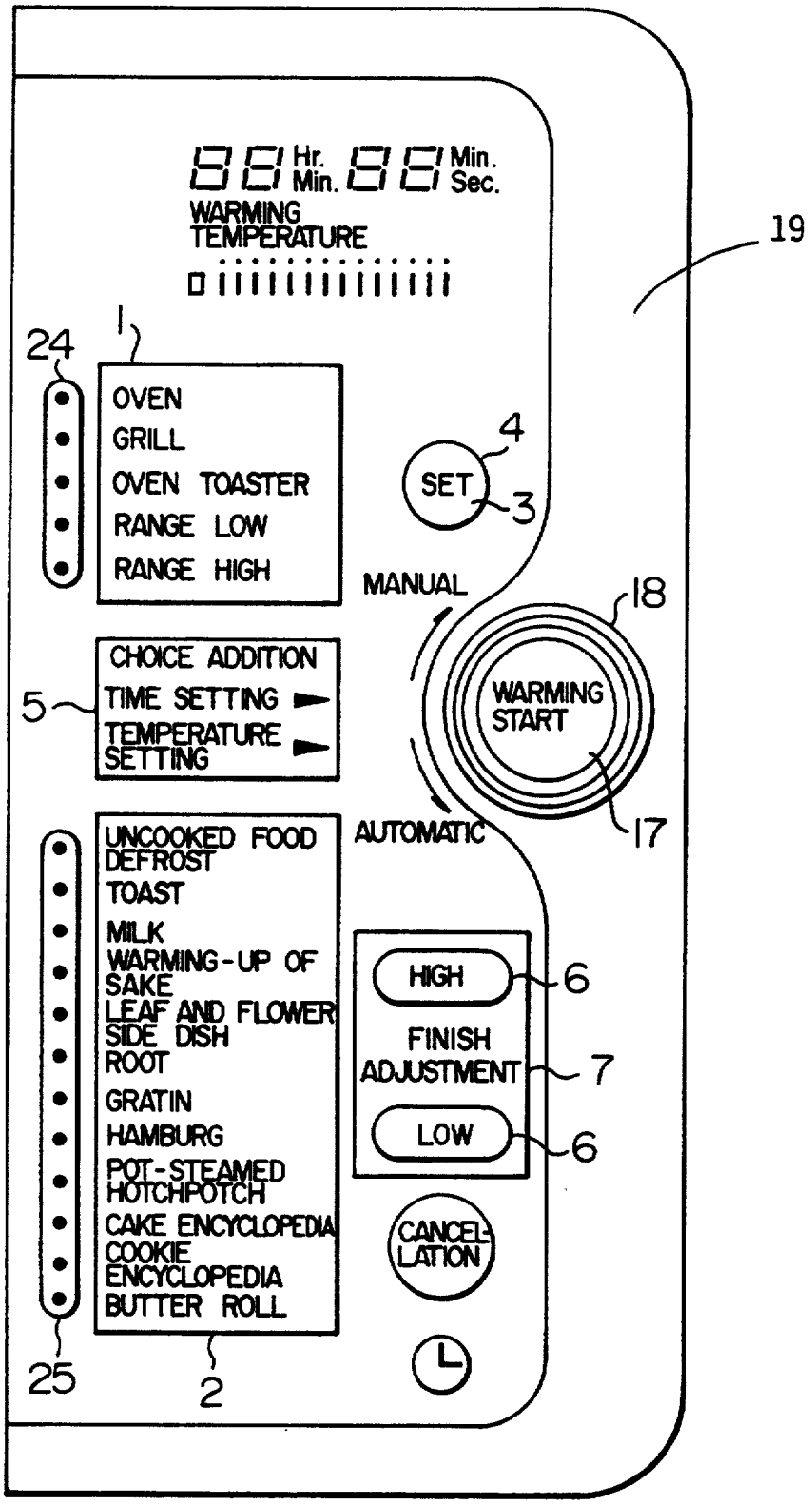
FIGS. 2, 6 and 11 are views illustrating the external appearances of the manipulating section of the microwave oven in the embodiment shown in FIG. 1.

First, referring to FIGS. 1 and 2, a group of cooking menus is divided into a first group of cooking menus (a group of manual cooking menus), a second group of cooking menus (a group of automatic cooking menus) and a third group of cooking menus, which are different in genre or style from each other.

Each of the group of manual cooking menus is performed in such a way that a user sets a cooking time and a cooking temperature.

On the contrary, each of the group of automatic cooking menus is carried out in accordance with signals from a weight sensor, a steam sensor and the like and does not require the user to set a cooking time and a cooking temperature, and if the user selects a cooking menu, cooking can automatically be performed. Further each of the third cooking menus is performed in accordance with signals from sensors similar to those of the group of automatic cooking menus, and is for "warming" (AUTO MICROWAVE COOK) which is most frequently used.

A display section for the first group of cooking menus 1 (hereinafter referred to as "display section for manual cooking menus") displays the first group of cooking menus (hereinafter referred to as "group of manual cooking menus"). A display section for the second group of cooking menus 2 (hereinafter referred to as "display section for the group of automatic cooking menus") displays the second group of cooking menus (hereinafter referred to as "group of automatic cooking menus").

A control section 9 (hereinafter referred to as "microcomputer") controls the display section 1 for the group of manual cooking menus and a setting display section 24 for the group of manual cooking menus, the display section 2 for the group of automatic cooking menus and a setting display section 25 for the group of automatic cooking menus, a temperature and time setting display section 5, and a setting key display section 7 under manipulation of a selective setting means 8 (hereinafter referred to as "an encoder"), cooking start means 10 (hereinafter referred to as "start key section"), a setting key section 3 and a finish adjustment key section 6.

Referring to FIG. 2, there is shown a knob 18 which projects from a surface 19 (hereinafter referred to as "a base") of the manipulating section. There is a start button 17 within the knob 18. The knob 18 is so arranged as to be interlocked with rotational operation of the encoder 8. The start button 17 is so arranged as to be interlocked with the start key section 10. Accordingly, the encoder 8 is rotatable. Depending upon the rotational direction of the encoder 8, the group of manual cooking menus or the group of automatic cooking menus is selected. Depending upon the degree of rotation of the encoder 8, the cooking menu is selected from the selected group of cooking menus. Further, regarding setting of a time and a temperature which are required for the manual cooking menu, the time and the temperature are inputted from the encoder 8.

Figure 3A:
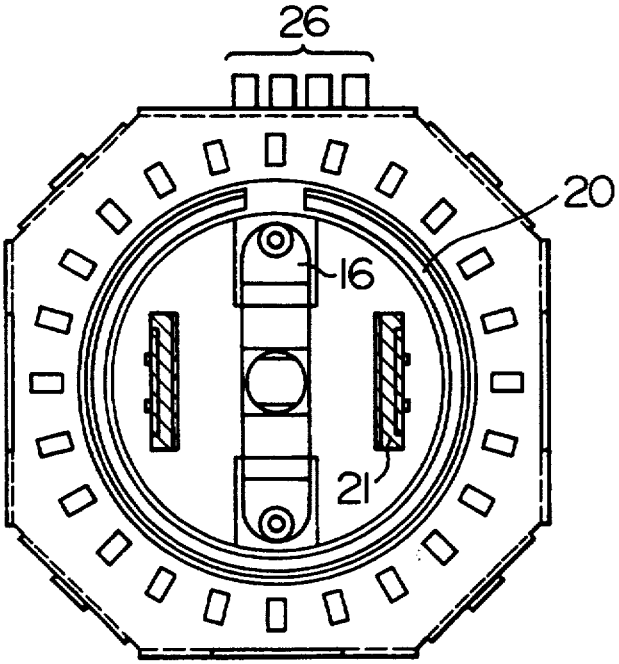
FIGS. 3A, 3B and 3C are views illustrating an encoder.
Figure 3C:
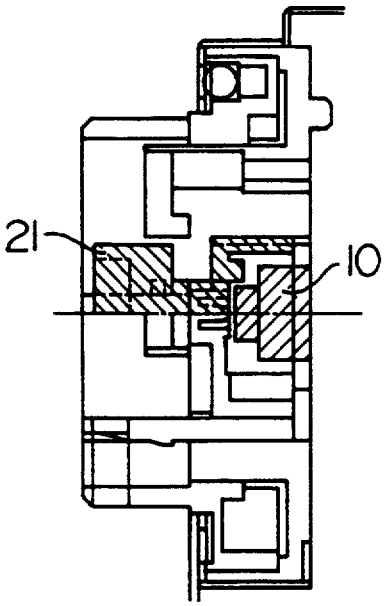
Figure 3B:
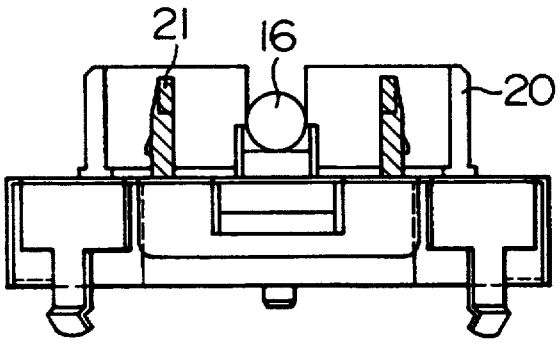

Referring to FIGS. 3(A), 3(B) and 3(C), the encoder 8 is provided with a rotating portion 20 which can be rotated in either of left- and right-hand directions. The degree of the rotation is outputted from terminals 26 as electric signals. The electric signals are processed by the microcomputer so as to control the entire operating section. Moreover, as shown in FIG. 3(C), the arrangement is as follows. The start key section 10 is arranged at a lower portion of the encoder 8, whereby, if a switch mechanism portion 21 of the encoder 8 is pushed, the start key section 10 is pushed so that the encoder 8 is turned on.

Furthermore, a lamp 16 is mounted within the encoder 8.

Figure 4:
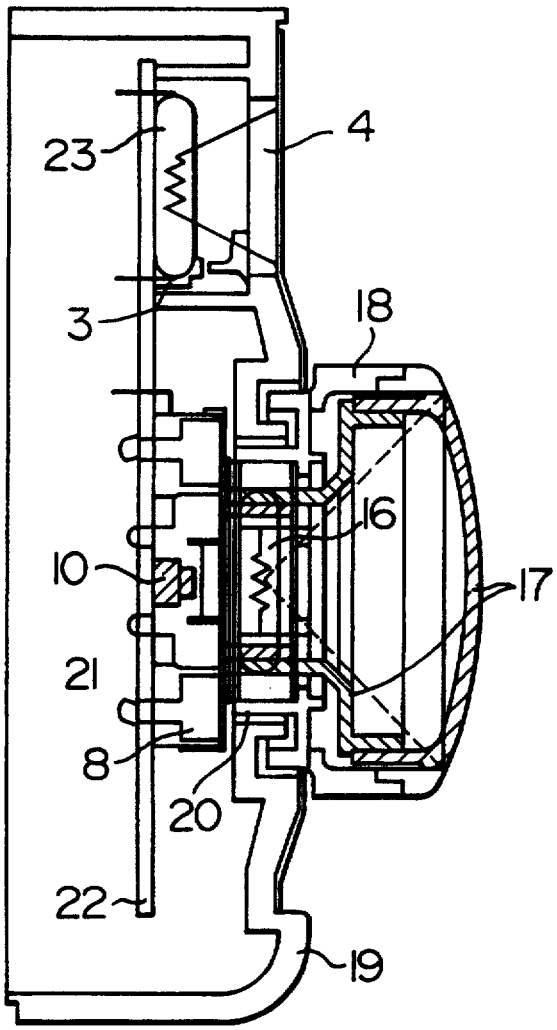
FIG. 4 is a cross-sectional view illustrating the manipulating section of the microwave oven in the embodiment shown in FIG. 1.

Referring to FIG. 4, the encoder 8, the start key section 10 and the lamp 16 are mounted on a printed circuit board 22. Further, a rotating portion 20 of the encoder 8 is interlocked with the knob 18. The start button 17 is interlocked with the switch mechanism portion 21 of the encoder 8. Moreover, the start button 17 is arranged within the knob 18. These elements project from the surface 19 (hereinafter referred to as "a base") of the manipulating section. Accordingly, this is easy to use for the user.

The user rotates the knob 18, and thereby the rotating portion 20 of the encoder 8 is rotated. Further, the user pushes the start button 17 so that the start key section 10 is pushed.

Moreover, the setting key section display portion 4 is arranged such that a lamp 23 is mounted on the printed circuit board, and is turned on and off in association with the turn-on or -off operation of the lamp 23 The other display portions are similarly turned on and off.

Figure 5:
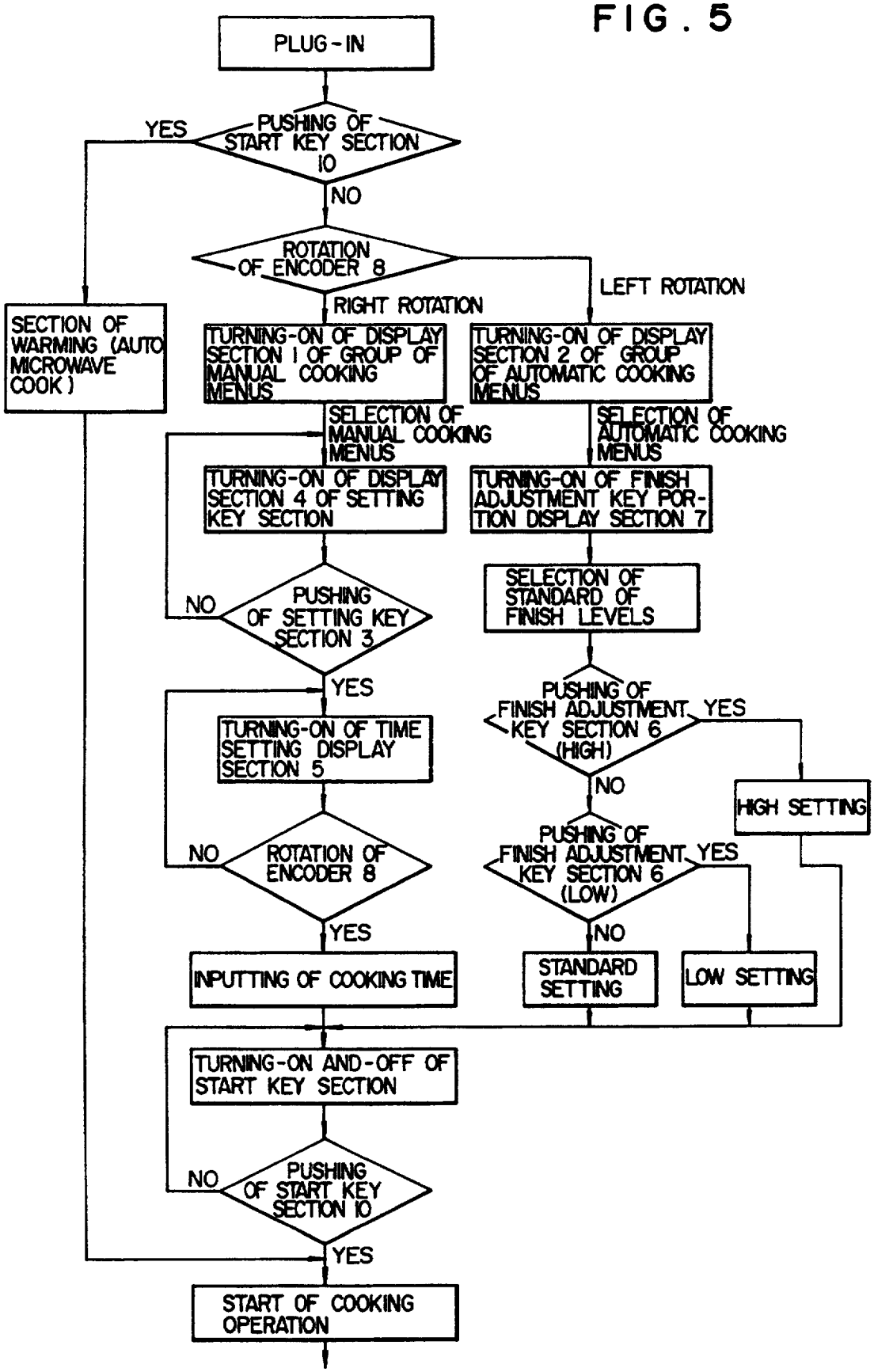
FIG. 5 is a flow chart for explaining the manipulation of the microwave oven in the embodiment shown in FIG. 1.
Figure 6:
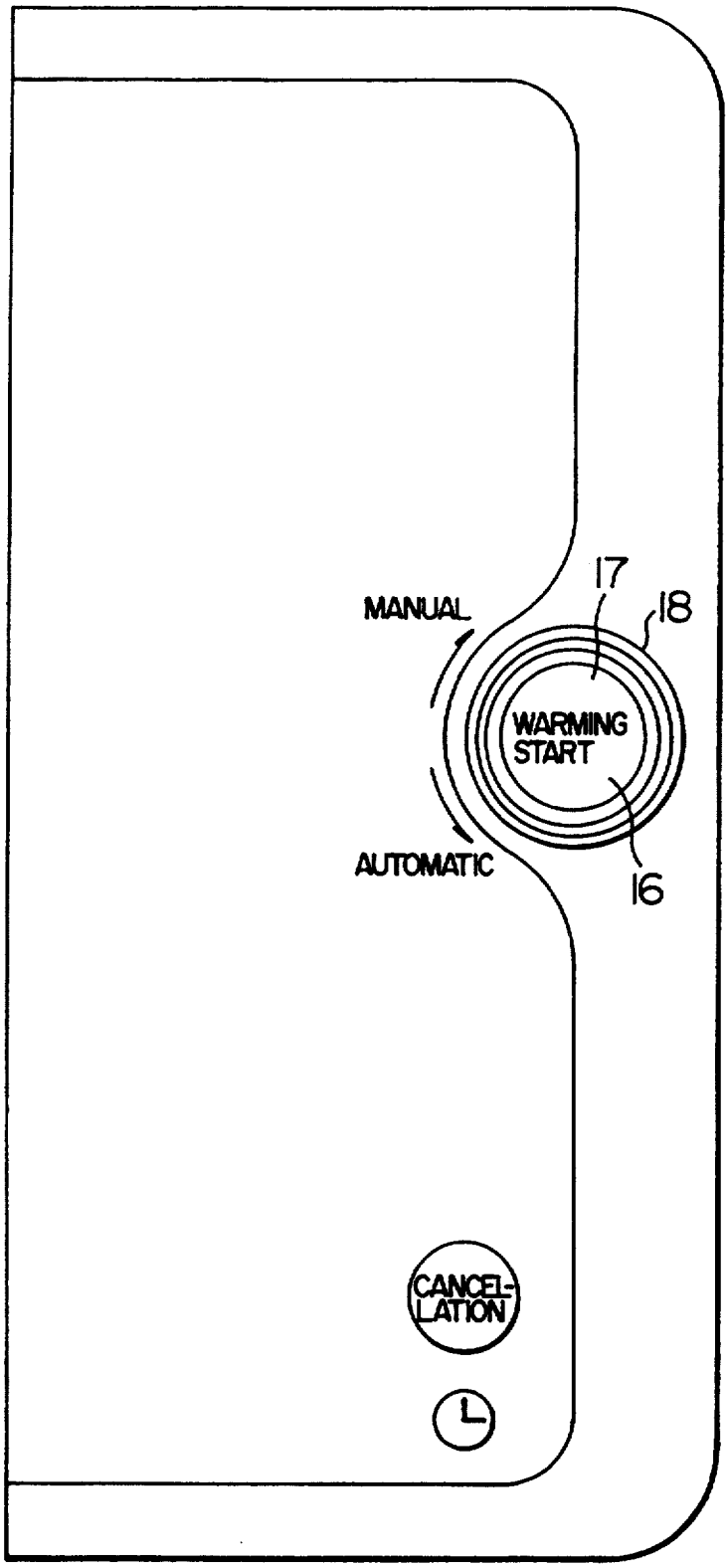

Referring to FIG. 5, a method of manipulation will be described. First, under a condition such that the electronic range is connected to a power source, that is, under a plug-in condition, the manipulating section is brought into a condition shown in FIG. 6. Displayed are extremely limited sections. This is because the manipulating section of the invention is arranged such that only display sections in a portion corresponding to the object of the operation are turned on and displayed.

If the start button 17 is pushed, that is, the start key section 10 is pushed, the third cooking menu "warming" (AUTO MICROWAVE COOK) is selected so that the cooking operation starts.

The cooking menu "warming" is most frequently used so that the setting and cooking start can be performed by the simplest operation. Thus, the manipulation thereof can be improved.

Then, the knob 18 is rotated whereby the encoder 8 is rotated in order to select a group of cooking menus and one of the menus in the group. In a case where the knob 18 is rotated in a right-hand direction, the group of manual cooking menus and one of the group are selected. In a case where the knob 18 is rotated in a left-hand direction, the group of automatic cooking menus and one of the group are selected.

Figure 7:
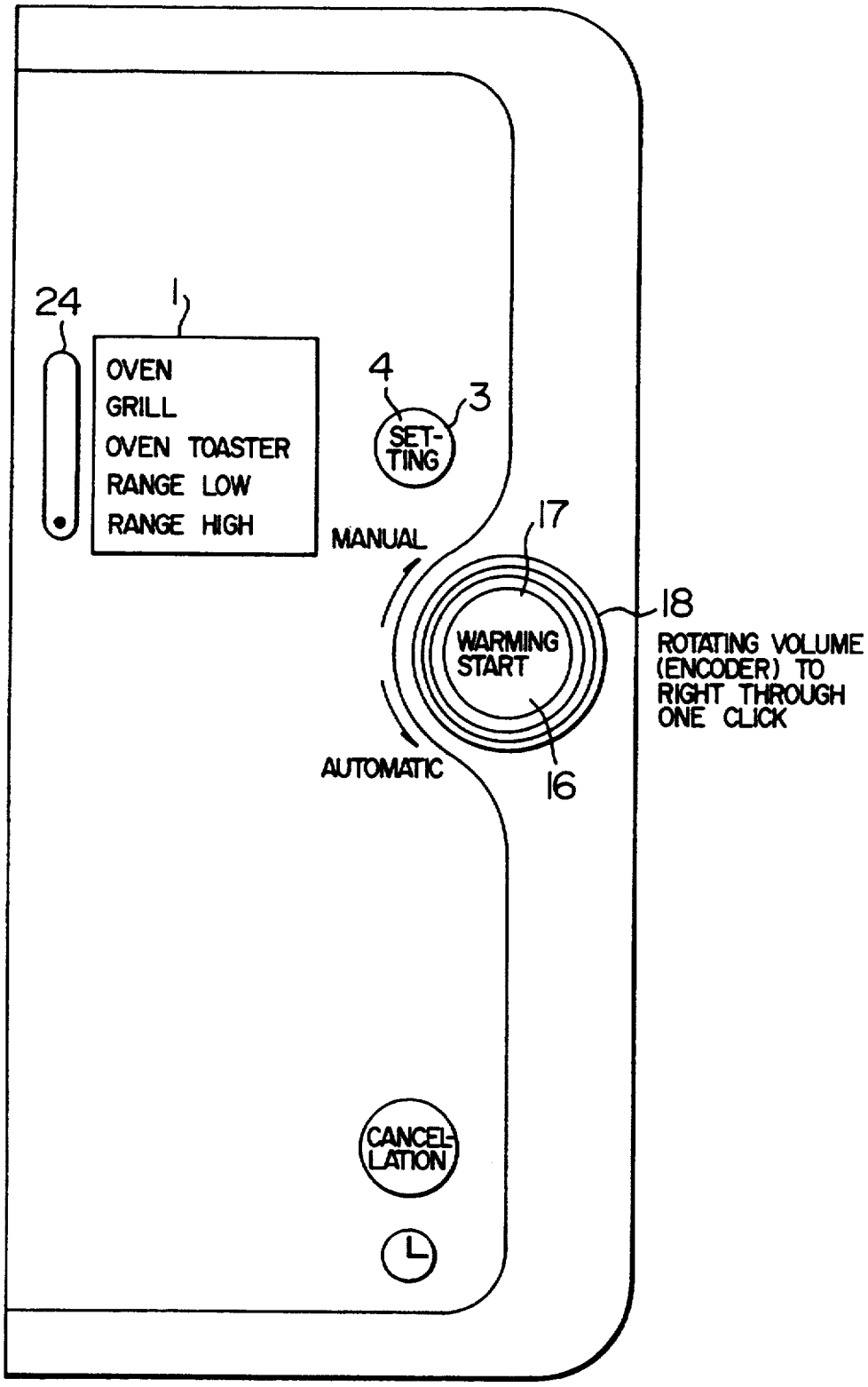
FIGS. 7, 8, 9 and 10 are views for explaining the manipulation of the microwave oven in the embodiment of the invention.

Now, in a case where the knob 18 (that is, the encoder 8) is rotated to the right through one click, the group of manual cooking menus is selected, and the display section 1 for the group of manual cooking menus is turned on as shown in FIG. 7. A position of "range high" which is located at the lowermost position of the setting display section 24 for the group of manual cooking menus, for indicating which menu or what menu is selected at the present is illuminated for indication of the selected menu "range high". Then, the setting key section display portion 4 which lights up (displays) the setting key section 3 which switches input signals indicating (a time, a temperature and the like) required for the manual cooking menu is flashed to urge the user to manipulate.

When the knob 18 (that is, the encoder 8) is rotated to the right further by one click, the position of "range low" which is located at the second position from the below of the setting display section 24 for the group of manual cooking menus is turned on so that "range low" is selected. If the knob 18 is further rotated, "an oven toaster", "a grill" and "an oven" are subsequently selected.

Accordingly, the higher the menu is positioned on the setting display section for the group of manual cooking menus, the larger the angle through which the knob 18 (that is, the encoder 8) must be turned. Also, the higher the frequency of a menu, the lower the menu is positioned, and accordingly, the higher the frequency of use of a menu, the smaller the degree of rotation of the knob 18 (that is, the encoder 8) becomes. Thus, the manipulation can be improved.

Figure 8:
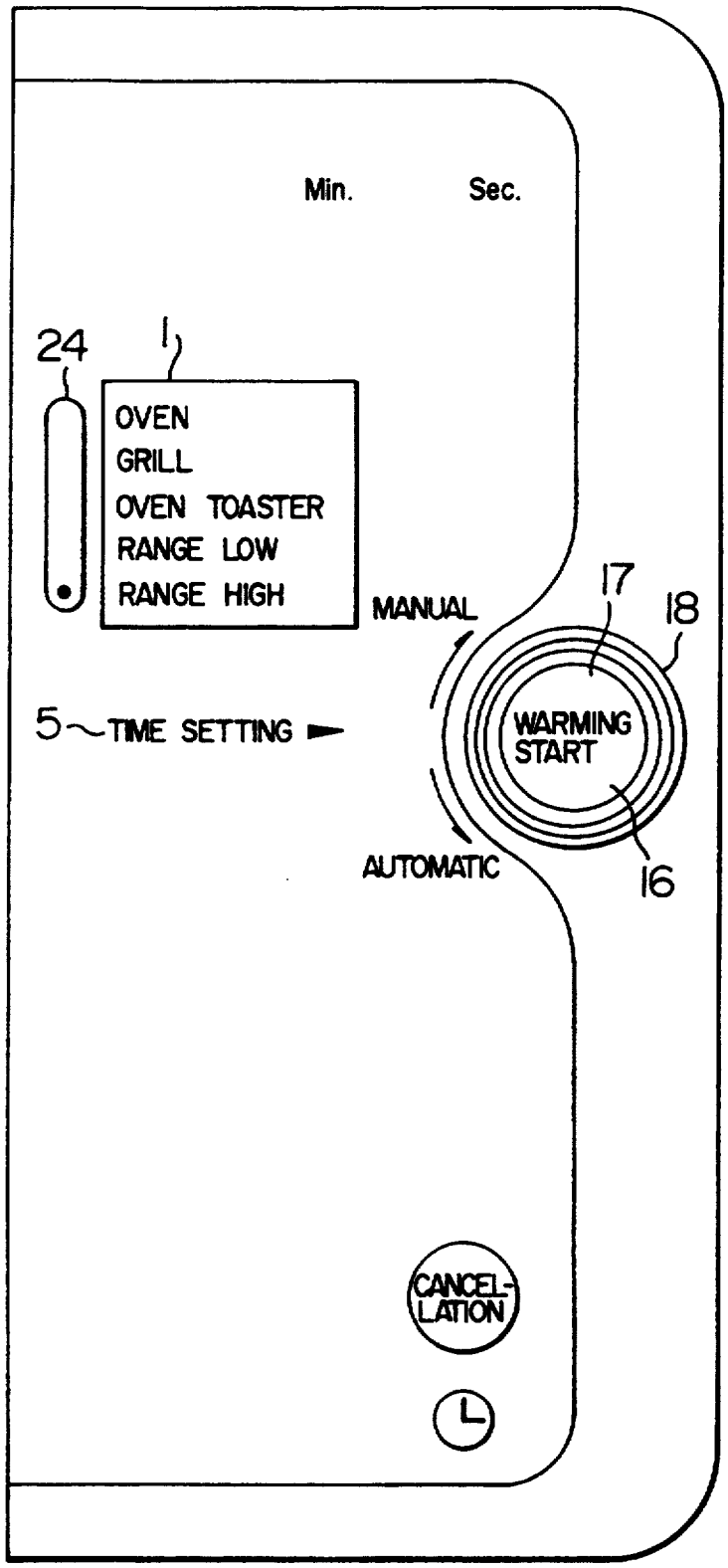
Figure 9:
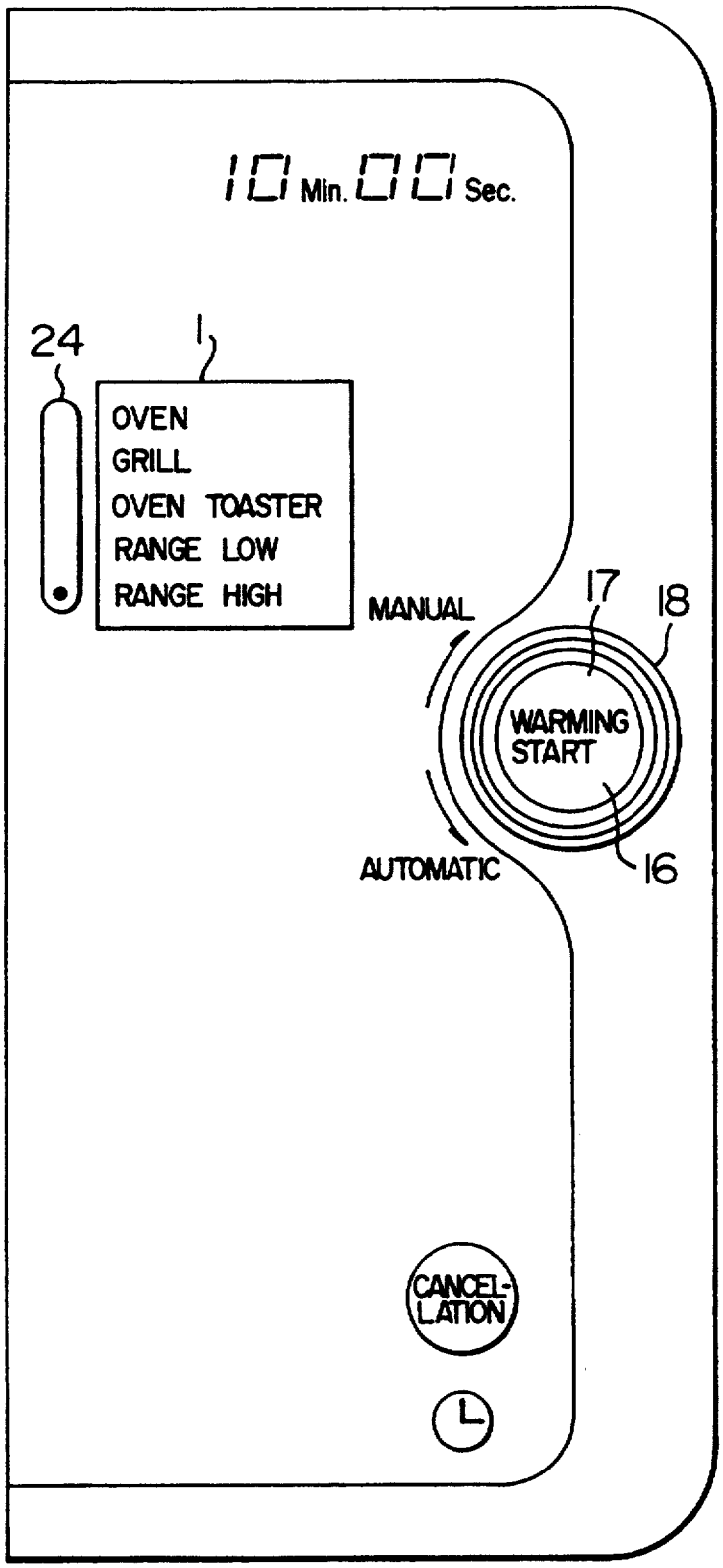

Now, in a case where "range high" is selected, if the setting key section 3 is next pushed, the cooking menu is fixed to "range high" as shown in FIG. 8. The time setting display section 5 for the menu of "range high" is illuminated so as to urge the user to input a cooking time through the knob 18 (that is, the encoder 8). When the knob 18 (that is, the encoder 8) is rotated, a time is set in accordance with the degree of rotation of the knob 18. As shown in FIG. 9, it is brought into a condition so as to start the cooking. The start button 17 is flashed to urge start. When the start button 17 is pushed, the start key section 10 is pushed so that the cooking operation starts.

Figure 10:
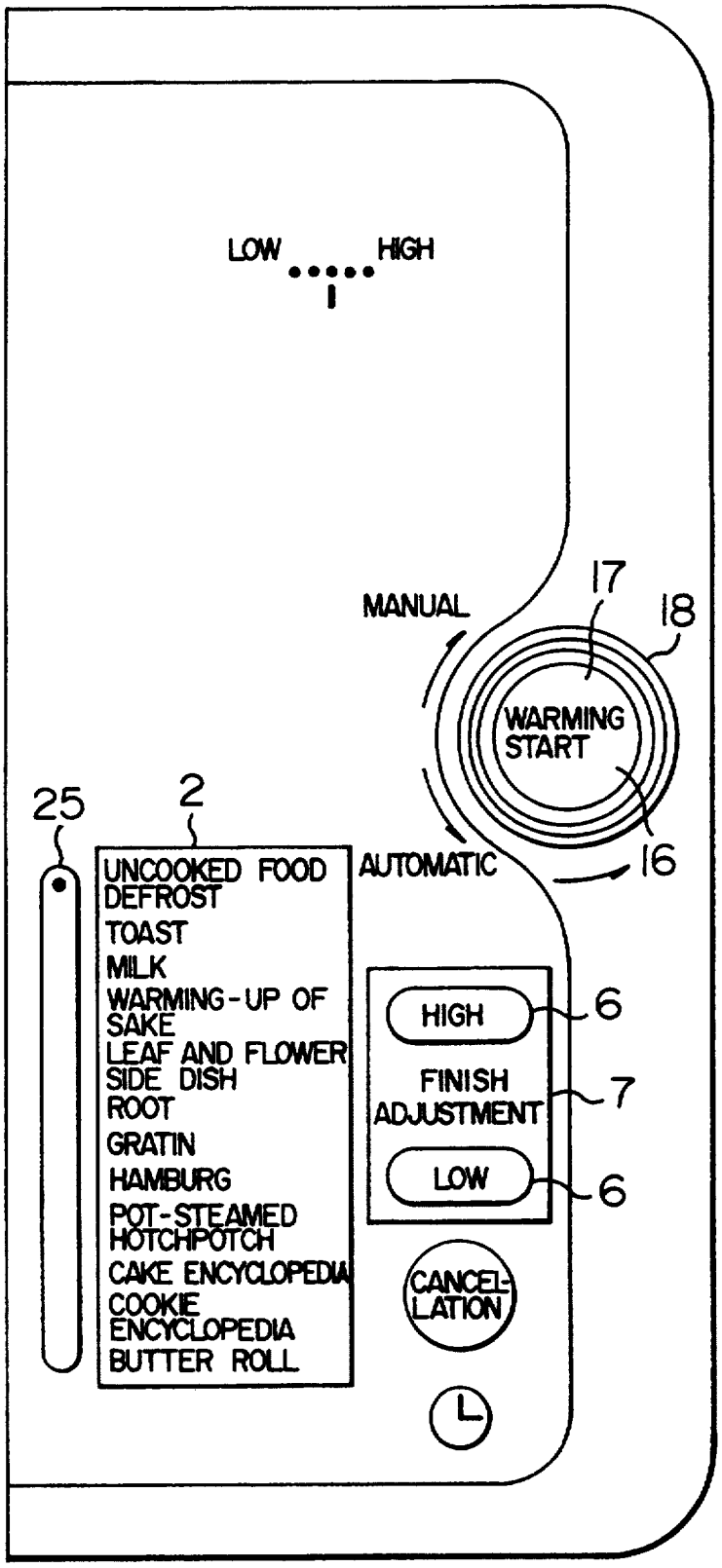
Figure 11:
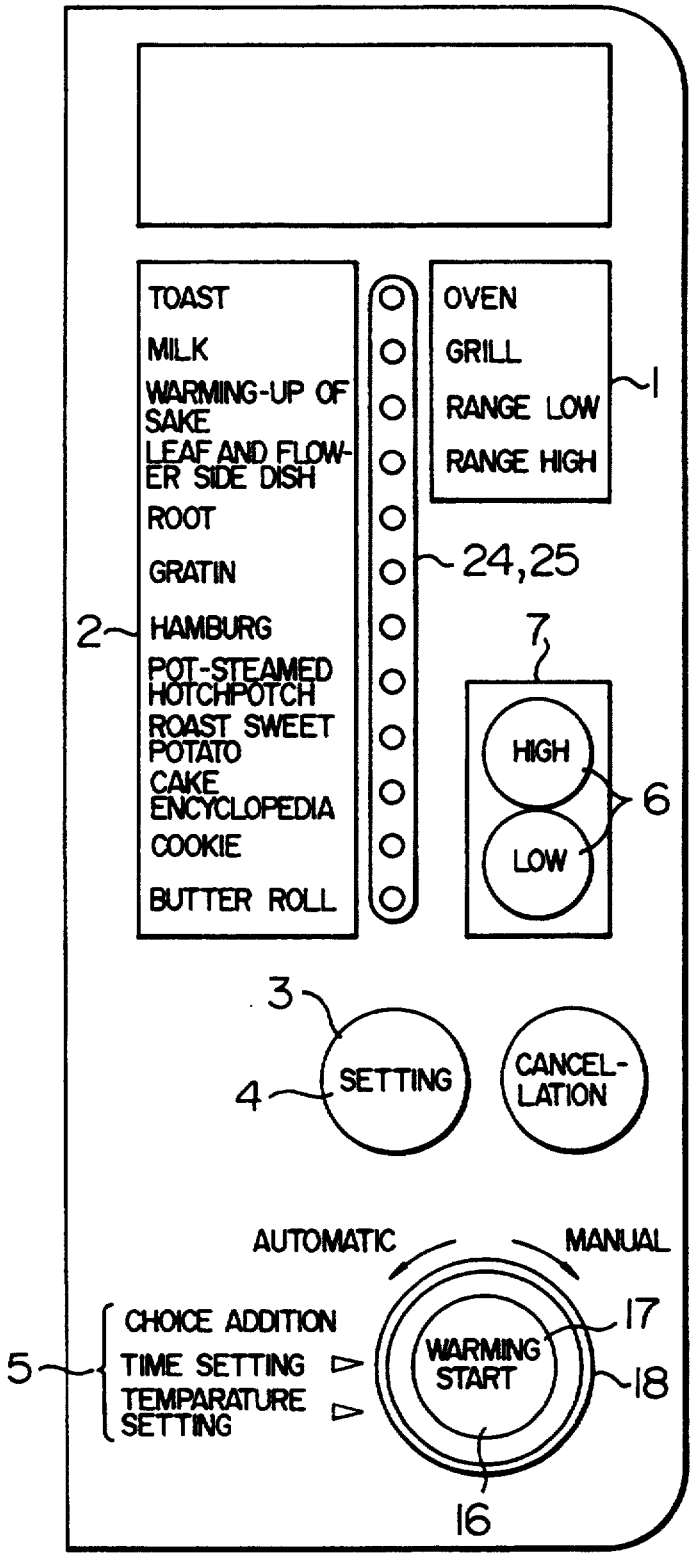
Figure 12:
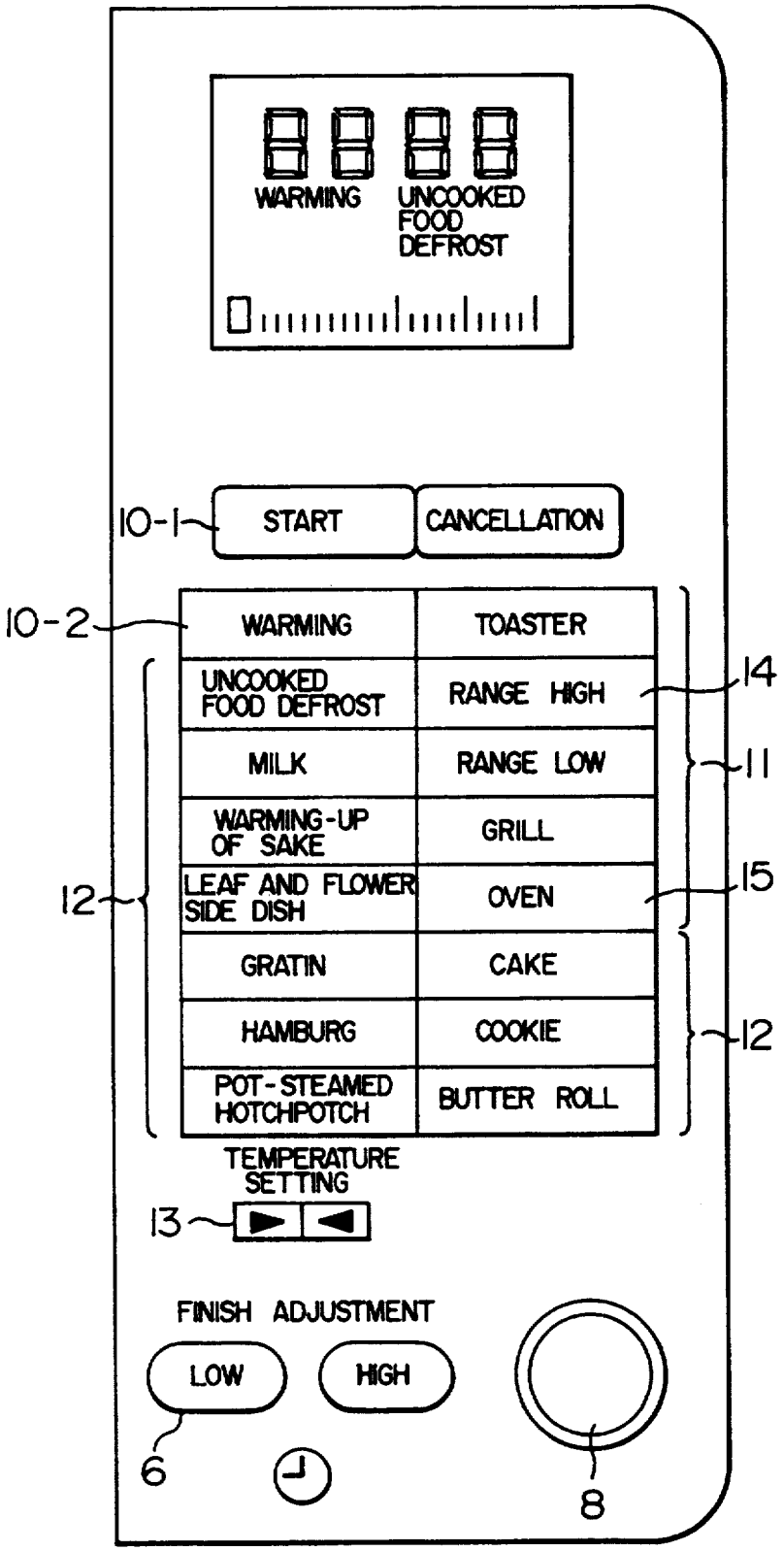
FIG. 12 PRIOR ART
FIG. 12 is a view illustrating the external appearance of a manipulating section of a conventional electronic range.

Next, in a case where the knob 18 (that is, the encoder 8) is rotated from the plug-in condition to the left through one click, the group of automatic cooking menus is selected. As shown in FIG. 10, the display section 2 for the group of automatic cooking menus is illuminated. A location of "uncooked food defrost" (DEFROST) which is located at the highest position of the setting display section 25 for the group of automatic cooking menus, for indicating which menu is selected at the present is illuminated to indicate that "uncooked food defrost" is selected at present. These automatic cooking menus have a function of finish adjustment in which the user can adjust the finishing of cooking in three stages. Accordingly, since there is the possibility of adjustment of finish, the finish adjusting key portion display section 7 is illuminated so that the user can readily manipulate it. If the key of "high" of the finish adjustment key section is pushed, the finish adjustment is strengthened. Furthermore, when a key of "low" of the finish adjustment key section is pushed, the finish adjustment is weakened. If no keys are pushed, the finish adjustment is standard.

Next, when the knob 18 (that is, the encoder 8) is rotated further to the left by one click, a position of "toast" located at the second position from the above of the setting display section 25 for the group of automatic cooking menus is illuminated so that "toast" is selected. If the knob 18 is rotated further to the left, "milk", "warming of sake" and "leaf and flower side dish" are subsequently selected in order.

Accordingly, the larger the rotation of the knob 18 (that is, the encoder 8), the lower the menu on the display section 2 for the group of automatic cooking menus is selected. That is, the higher the frequency of use of a menu, the higher the menu is positioned, Accordingly, the higher the frequency of a menu, the smaller the rotation of the knob 18 for selecting the menu becomes, thereby making it possible to improve the manipulation of the microwave oven.

Now, in a case where "uncooked food defrost" is selected, it is brought into a condition in which the cooking can be started, regardless of whether or not the finish adjustment key section 6 is manipulated. The start button 17 is flashed to urge start. When the start button 17 is pushed, the start key section 10 is operated so that the cooking operation is started.

As mentioned above, the manipulation is concentrated on the knob 18 (that is, the encoder 8), thereby making it possible to simplify the manipulation with the use of the cooking menus. Moreover, the setting key portion display section 4, the temperature and time setting display section 5, the finish adjustment key portion display section 6 and the start key section 16 are provided, and display is made by illuminating them one by one only when they are required thereby further improving the manipulation. Further, regarding the display, the illumination indicates that the associated key can be manipulated while flashing indicates urging the associated key to be pushed, thereby making it possible to use the display for distinguish a necessary manipulation from the others.

Furthermore, as described previously, a judgment as to whether the group of manual cooking menus or the group of automatic cooking menus is selected, can be made depending upon the rotational direction of the knob 18 (that is, the encoder 8). Referring to FIG. 9, in a case where the knob 18 (that is, the encoder 8) is rotated to the right, the group of manual cooking menus is selected, and the display section 1 for the group of manual cooking menus is displayed.

Further, referring to FIG. 10, in a case where the knob 18 (that is, the encoder 8) is rotated to the left, the group of automatic cooking menus is selected so that the display section 2 for the group of automatic cooking menus is displayed. Accordingly, the positional relationship between the display section 1 for the group of manual cooking menus and the display section 2 for the group of automatic cooking menus is such that, in a case where the display sections exist on the left and the right, the display section for the group of manual cooling menus is arranged to the right, and the display section for the group of automatic cooking menus is arranged to the left, thereby the display section for the group of cooking menus exists at a position corresponding to the rotational direction of the encoder so that it is very easy to see the display section. Thus, the manipulability is further improved.

Further, in a case where these groups of cooking menus exist vertically, the display section 1 for the group of manual cooking menus is arranged at an upper side, while the display section 2 for the group of automatic cooking menus is arranged at a lower side, whereby the display sections for the groups of cooking menus exist in the rotational direction of the knob 18 (that is, the encoder 8). Thus, manipulability is further improved.

As described above, according to the invention, there can be produced the following advantages:

(1) Selection of all the cooking menus and the start of operation are substantially completed only by a manipulation in the manipulating section (only one knob 18 (that is, the encoder 8)) is manipulated but the input keys which are widely distributed on the manipulation panel are not used, thereby it is possible to simplify the manipulation. Thus, the manipulating section can be used easily.

(2) The position of the display section 1 for the group of manual cooking menus and the position of the display section 2 for the group of automatic cooking menus are arranged vertically and horizontally, thereby the manipulability can be improved.

(3) The display section for the group of manual cooking menus and the display section for the group of automatic cooking menus are arranged from an upper location or from a lower location in order that, the higher the frequency of use of a menu, the higher or the lower the menu is positioned in the manipulating section, whereby the manipulability can be improved. Moreover, only by pushing the start button, a menu having a highest using frequency can be set and cooking is started. Thus, the manipulation can be greatly improved.

What is claimed is:

1. A control system for starting a cooking operation comprising first and second groups of cooking menus;

first and second display sections for displaying said first and second groups of cooking menus respectively; and a rotatable selective setting means for controlling said first and second display sections, a menu from said first group of cooking menus being selected and displayed on said first display section when said selective setting means is rotated in a first direction through a predetermined angle corresponding to the menu selected from said first group, and a menu from said second group of cooking menus being displayed on said second display section when said selective setting means is rotated in a second direction through a predetermined angle corresponding to the menu selected from said second group.

2. A control system according to claim 1 which further comprises a cooking start means integral with said selective setting means, operation of said cooking start means starting said cooking operation.

3. A control system according to claim 2 which further comprises a setting key section and a time setting display section, rotation of said selective setting means, after selection of a menu from said first group of cooking menus and operation of said setting key section, setting a cooking time on said time setting display section.

4. A control system according to claim 2 which further comprises a finish adjusting key section for selecting a desired finish after selection of a menu from said second group of cooking menus.

5. A control system according to claim 2 which further comprises a third cooking menu, operation of said cooking start means selecting said third cooking means and starting said cooking operation.

6. A method of starting a cooking operation utilizing a control system comprising first and second groups of cooking menus, first and second display sections for displaying said first and second groups of cooking menus respectively, a rotatable selective setting means for controlling said first and second display sections, and a cooking start means, comprising the steps of rotating the selective setting means in a first or second direction through a given angle;

selecting the first or second group of cooking menus in accordance with the direction of rotation of the selective setting means;

selecting a specific menu within the selected group of cooking menus in accordance with the angular rotation of the selective setting means; and operating the cooking start means to start the cooking operation.

* * * * *